US007024998B2

(12) United States Patent
Dryer et al.

(10) Patent No.: US 7,024,998 B2
(45) Date of Patent: Apr. 11, 2006

(54) PROJECTILE WITH PROPELLING CHARGE HOLDER

(75) Inventors: Richard Dryer, Oro Valley, AZ (US); Andrew J. Hinsdale, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/609,235

(22) Filed: Jun. 27, 2003

(65) Prior Publication Data

US 2005/0082419 A1 Apr. 21, 2005

(51) Int. Cl.
*F42B 15/00* (2006.01)

(52) U.S. Cl. ..... 102/373; 102/445

(58) Field of Classification Search ..... 244/3.3, 244/3.24; 102/288, 373, 285, 445, 375, 439
See application file for complete search history.

(56) References Cited

U.S. PATENT DOCUMENTS 1,879,840 A * 9/1932 Brandt ..... 244/3.28
2,315,145 A * 3/1943 Wauters ..... 244/3.24
3,789,763 A * 2/1974 Donner ..... 102/373
3,915,091 A * 10/1975 Smith et al. ..... 102/373
4,549,487 A * 10/1985 Jensen ..... 102/498
5,080,017 A * 1/1992 Asikainen ..... 102/372
5,175,393 A * 12/1992 Andersson ..... 102/373
5,228,855 A * 7/1993 Frost ..... 434/12

FOREIGN PATENT DOCUMENTS

DE 3310633 A1 * 9/1984
EP 0090155 A2 * 10/1983

* cited by examiner

*Primary Examiner*—T. Nguyen
(74) *Attorney, Agent, or Firm*—Renner, Otto, Boiselle & Sklar, LLP

(57) ABSTRACT

A projectile, such as a mortar projectile, includes a self-discarding or self-consumable propelling charge holder. A self-discarding propelling charge holder is made up of multiple segments. The propelling charge holder is maintained in place during launch by an igniter holder, and by folding fins of the projectile. The propelling charge increments are consumed during the launch process. After launch, as the folding fins deploy, the segments of the propelling charge holder separate from each other and from the remainder of the projectile, and the igniter holder is forcibly removed from the propelling charge holder segments. Alternatively, the propelling charge holder may be self-consumable, being made of a material that is consumed along with the propelling charge increments.

23 Claims, 6 Drawing Sheets

PROJECTILE WITH PROPELLING CHARGE HOLDER

BACKGROUND OF THE INVENTION

1. Technical Field

The invention relates to projectiles, such as mortar projectiles, and in particular to devices for holding propellant charge for such projectiles.

2. Description of Related Art

Mortar projectiles are assembled with a number of consumable propelling charge increments or segments thereupon. A charge holder is used to support the charge increments prior to and during launch. Charge holders integral with the projectile have been employed. For fixed fin mortar projectiles, such integral charge holders have been utilized as a fin hub. For folding fin mortar projectiles, in which the fins are attached to the base of the projectile body, having an integral charge holder involves carrying the parasitic drag of the charge holder tube throughout flight. An alternative approach has been to discard the charge holder tube upon exit from the muzzle of a mortar launcher. However, this involves the risk that the discarded charge holder may fall upon friendly forces in the vicinity of the mortar, possibly resulting in undesirable casualties.

SUMMARY OF THE INVENTION

According to an aspect of the invention, a projectile includes a projectile body; and a propelling charge holder separably coupled to the projectile body. The propelling charge holder includes multiple propelling charge holder segments that are separable from one another during flight of the projectile.

According to another aspect of the invention, a method of launching a projectile includes the steps of igniting, in a cannon, propelling charge increments mounted on a propelling charge increment holder; and after the projectile exits the cannon, separating the propelling charge increment holder from a projectile body of the projectile. The separating includes separating, one from another, multiple propelling charge increment holder segments that are part of the propelling charge increment holder.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A projectile, such as a mortar projectile, includes a self-discarding or self-consumable propelling charge holder. A self-discarding propelling charge holder is made up of multiple segments. The propelling charge holder is maintained in place during launch by an igniter holder, and by folding fins of the projectile. The propelling charge increments are consumed during the launch process. After launch, as the folding fins deploy, the segments of the propelling charge holder separate from each other and from the remainder of the projectile, and the igniter holder is forcibly removed from the propelling charge holder segments. By separating the propelling charge holder after launch, the carrying of the parasitic drag of the charge holder during flight is avoided. The several segments of the propelling charge holder do not constitute a significant threat to personnel in the area of the mortar launch, due to their small size and weight. Alternatively, the propelling charge holder may be self-consumable, being made of a material that is consumed along with the propelling charge increments.

Figures 1, 2:
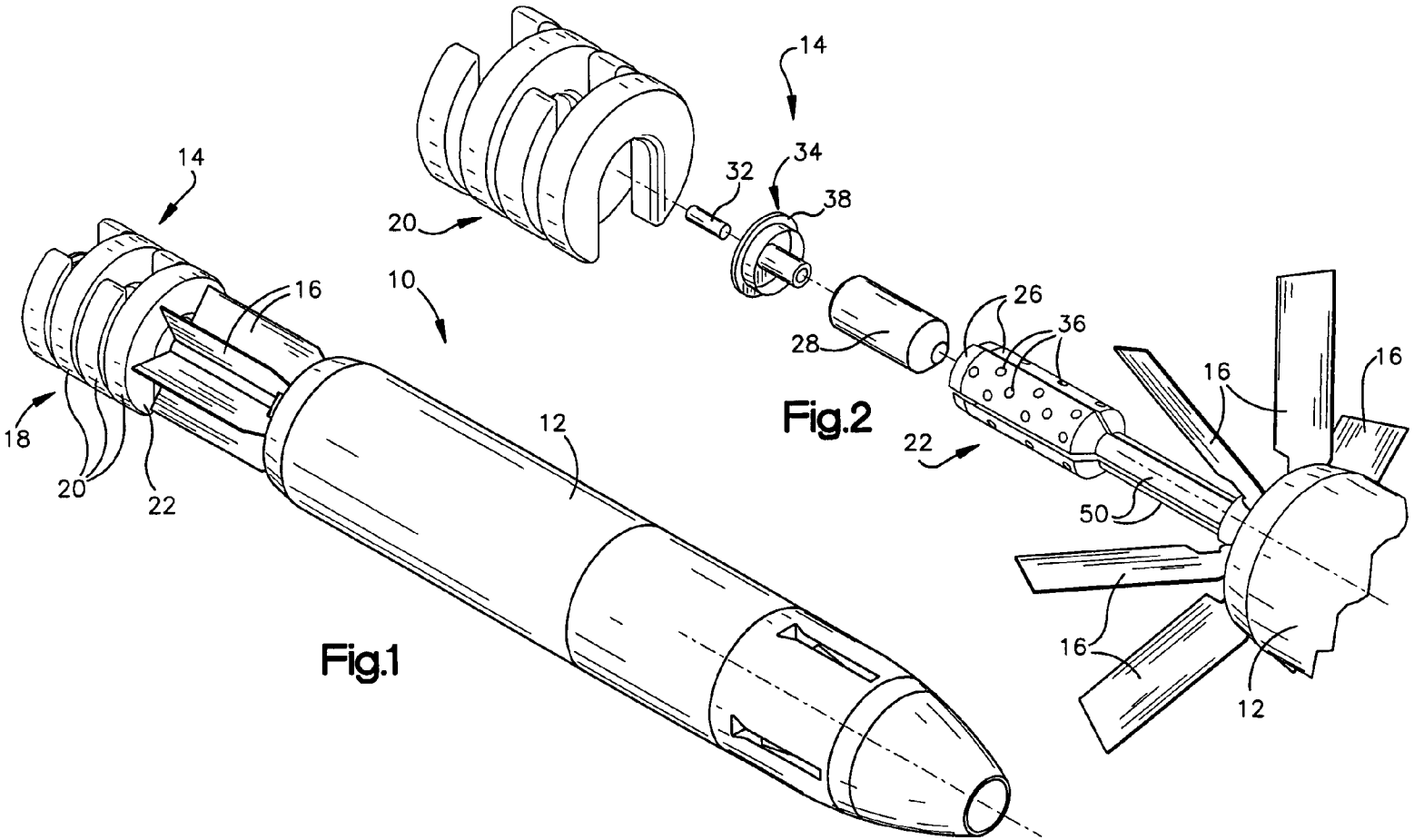
FIG. 1 is an oblique view of a projectile in accordance with the present invention.
FIG. 2 is an exploded view of part of the projectile of FIG. 1.

Referring now initially to FIG. 1, a projectile 10 of the present invention includes a projectile body 12, and a tail 14. The projectile 10 is described herein as a mortar projectile, although it may alternatively be other types of projectiles, such as surface-to-surface, surface-to-air, or air-to-surface guided or unguided projectiles. The body 12 includes any of a variety of well-known payloads or other components, for example, including explosives and the like. Other possible payloads include various types of guidance devices, communication devices, and control devices.

The tail 14 includes a number of folding fins 16 and a propulsion system 18. The folding fins 16 are initially in a stowed position, as shown in FIG. 1. After emergence from the cannon, the folding fins 16 are deployed, either actively or passively. Once deployed, the folding fins 16 aid in providing stable flight for the projectile 10.

The propulsion system 18 includes a number of external propelling charge increments 20, and a propelling charge holder 22. As described further below, the external propelling charge increments are made up of a propellant that chemically reacts in a combustion reaction within the cannon, to produce the pressurized gasses that propel the projectile 10.

Figure 3:
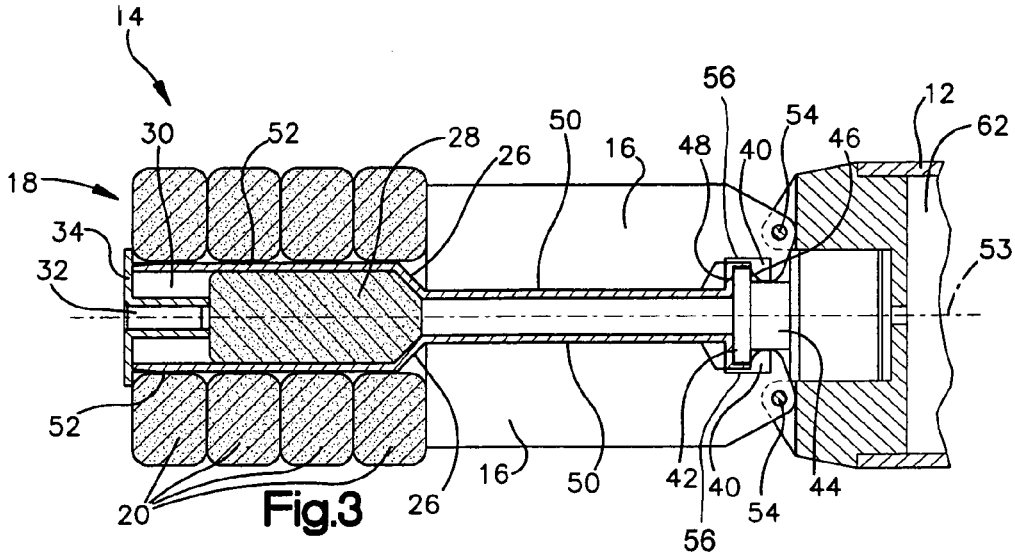
FIG. 3 is a cross-sectional view of part of the projectile of FIG. 1.

Turning now to FIGS. 2 and 3, the propelling charge holder 22 includes a plurality of segments 26, which are separate pieces that combine to form a structure that at least partially encircles an internal propelling charge increment 28 in a chamber 30. As described further below, the propellant charge holder 22 is longitudinally segmented into the plural propelling charge holder segments 26.

An igniter 32 is enclosed in an igniter holder 34 that is initially placed within the propelling charge holder 22. The igniter 32 is used to initiate reaction of the propelling charges 20 and 28. First the internal propelling charge increment 28 is ignited, causing a forceful of propellant gases that expels the igniter holder 34 from the propelling charge holder 22. Then the external propelling charge increments 20 are ignited, via holes 36 in the propelling charge holder segments 26. This combustion of the propelling charge increments 20 and 28 occurs within a cannon, and creates a large pressure force that forcefully expels the projectile 10 from the cannon.

The igniter holder 34 has an annular flange 38 that aids in holding the propelling charge holder segments 26 together.

The propelling charges 20 and 28 may be substantially completely consumed in the reaction to produce the pressurized gasses, thereby leaving substantially no solid residue. The propelling charges 20 may include a shell of felted nitrocellulose, filled with a suitable propellant material.

As best shown in FIG. 3, the propelling charge holder segments 26 have hooked ends 40 that are coupled onto a flange 42 on an aft projection 44 of the projectile body 12. The hooked ends 40 may have surfaces that contact both forward and aft surfaces (46 and 48, respectively) of the flange 42. The propelling charge holder segments 26 are maintained together and coupled to the flange 42 by the annular flange 38 of the igniter holder 34, which restrains the ends of the propelling charge holder segments 26, and by inward force from retracted folding fins 16. The fins 16 each have a notch 56 that fits over the hooked ends 40 of the propelling charge holder segments 26.

The propelling charge holder segments 26 may be made of a material such as aluminum or fiber reinforced plastic. Each of the segments may be a shell of such material, filled with a suitable propellant material. The shape that the propelling charge holder segments 26 initially have, when restrained and retained by the annular flange 38 and/or the folding fins 16, may be different than the shape achieved when the propelling charge holder segments 26 are free standing. That is, force may be used to press the segments 26 together and upon the flange 42 of the aft projection 44. Without the force of the annular flange 38 and/or the folding finds 16, the segments 26 may have a bowed shape, such as the shape shown in FIG. 4, with a central portion 50 bowed outward toward the ends. The inward radial force of the external propelling charge increments 20 and/or the folding finds 16 may be necessary for the segments 26 to fit together to provide the propelling charge holder with a substantially continuous surface enclosing the internal propelling charge increment 28.

Put another way, the propelling charge holder segments 26 may have an initial curvature in their free, unloaded state. This curvature is resiliently overcome by the mechanical load annular flange 38 of the igniter holder 34, and/or the load of the retracted fins 16, to hold the propelling charge holder segments 26 together, with the hooked ends 40 engaged upon the flange 42.

In addition to the narrow central portion 50, each of the segments 26 has a wider portion 52 at the opposite end from the hooked end 40. The narrow central portion is closer to a centerline 53 of the projectile 12 than either the wider portion 52 or the hooked end 40. The wider portion has sufficient width to accommodate the internal propelling charge increment 28 and the igniter holder 34 within. The narrow central portion 50 is closer to the centerline 53 in order to allow retraction of the fins 16.

Figure 4:
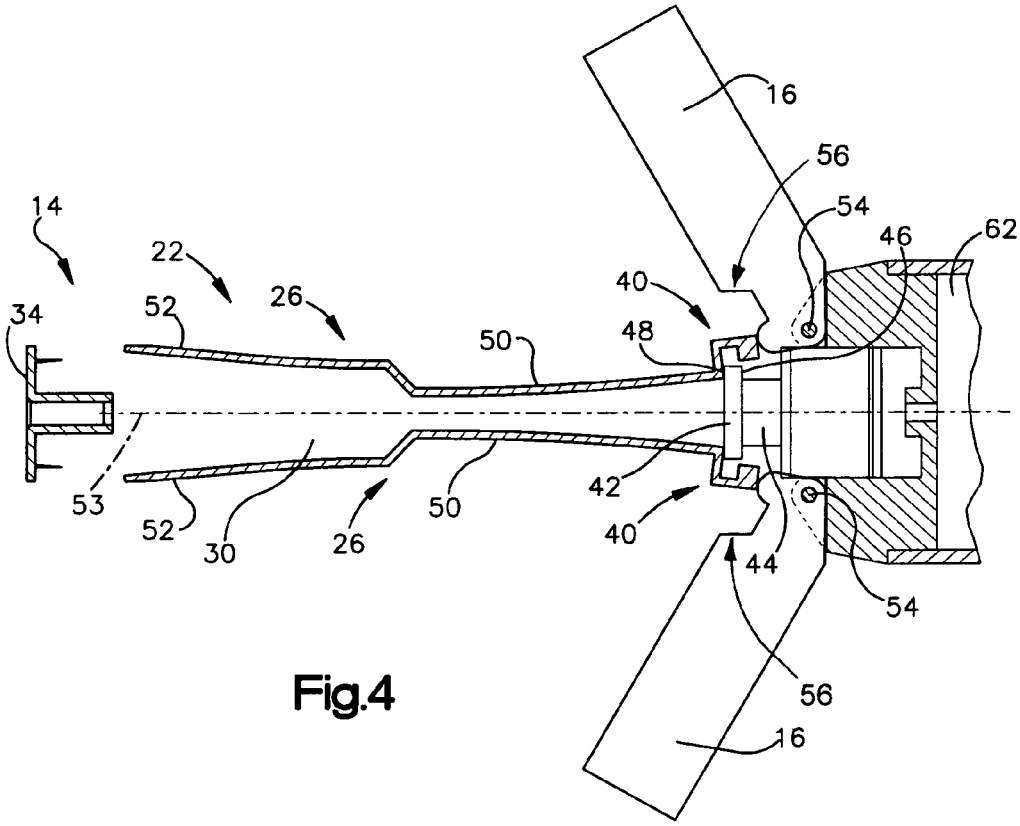
FIG. 4 is a cross-sectional view of the projectile part of FIG. 3, with fins of the projectile deployed.

As shown in FIG. 4, after the propelling charge increments 20 and 28 have been consumed, and after the projectile 10 leaves the cannon, the fins 16 deploy. The fins 16 rotate outward along hinge points 54. With the external propelling charge increments 20 and the folding fins 16 no longer constraining the propelling charge holder segments 26, the segments 26 spring back to their natural shape. This causes the hooked ends 40 of the segments 26 to disengage from the flange 42, thereby allowing the propelling charge holder 22 to separate from the projectile 10. The individual propelling charge holder segments 26 thereafter fall to the ground. Because multiple segments 26 are utilized, the weight and bulk of each of the segments 26 is small enough so that it does not constitute a significant hazard to nearby personnel. Each of the segments 26 may weight approximately 0.25 pounds.

It will be appreciated that the springing action of the individual propelling charge holder segments 26 aids in separating the segments 26 one from another, and sending them on separate trajectories. Elevated pressures within the propelling charge holder 22 may also provide a force to urge the segments 26 outward, aiding in disengagement of the hooked ends 40 from the flange 42.

Once the propelling charge holder 22 has been separated from the rest of the projectile 10, the remainder of the projectile 10 continues its flight, unhindered by the parasitic drag of a retained propelling charge increment holder. The projectile 10 may include a rocket motor 62 in the projectile body 12, which engages to allow powered flight for the projectile 10. In fact, pressure generated by the rocket motor 62 may drive the aft projection 44 backward to aid in deployment of the fins 16.

The illustrated embodiment has four of the segments 26. It will be appreciated that a greater or lesser number of segments may be employed. Furthermore, it will be appreciated that some of the advantages of the propelling charge holder 22 described above may be obtained without use of all of the above-described features. For example, the segments 26 may be separable from the projectile body 12 without use of the above-described "springing" feature.

Figure 5:
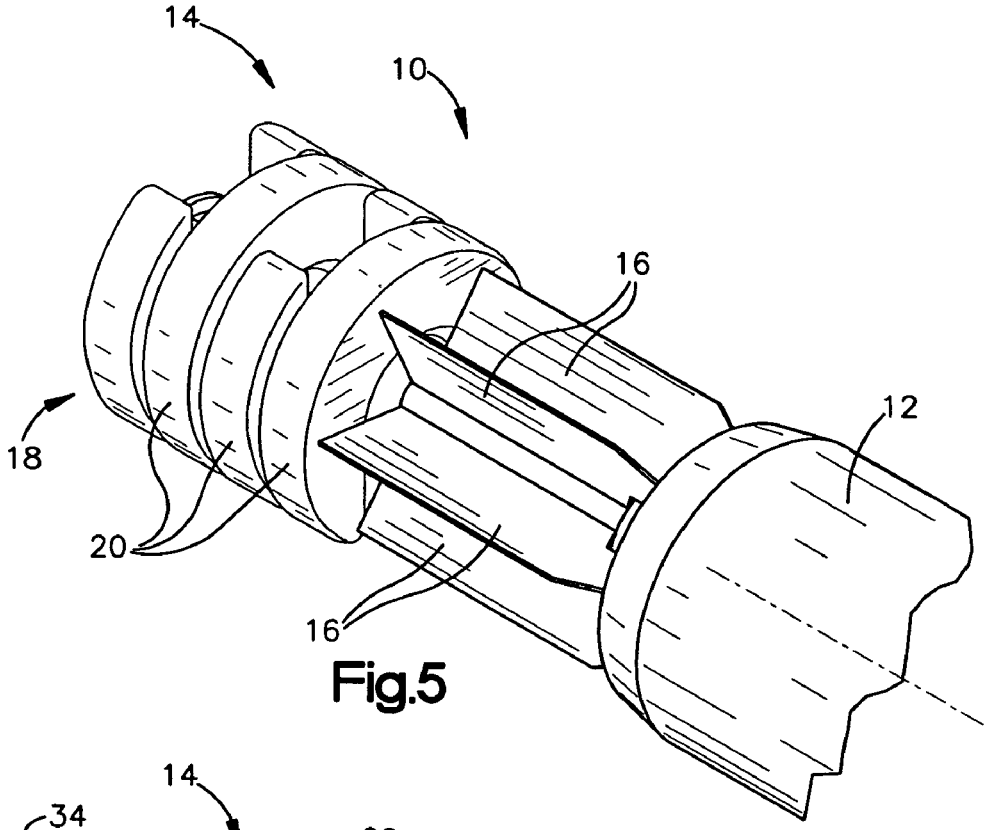
FIG. 5 is an oblique view illustrating a first step in the launch process of the projectile of FIG. 1.
Figure 6:
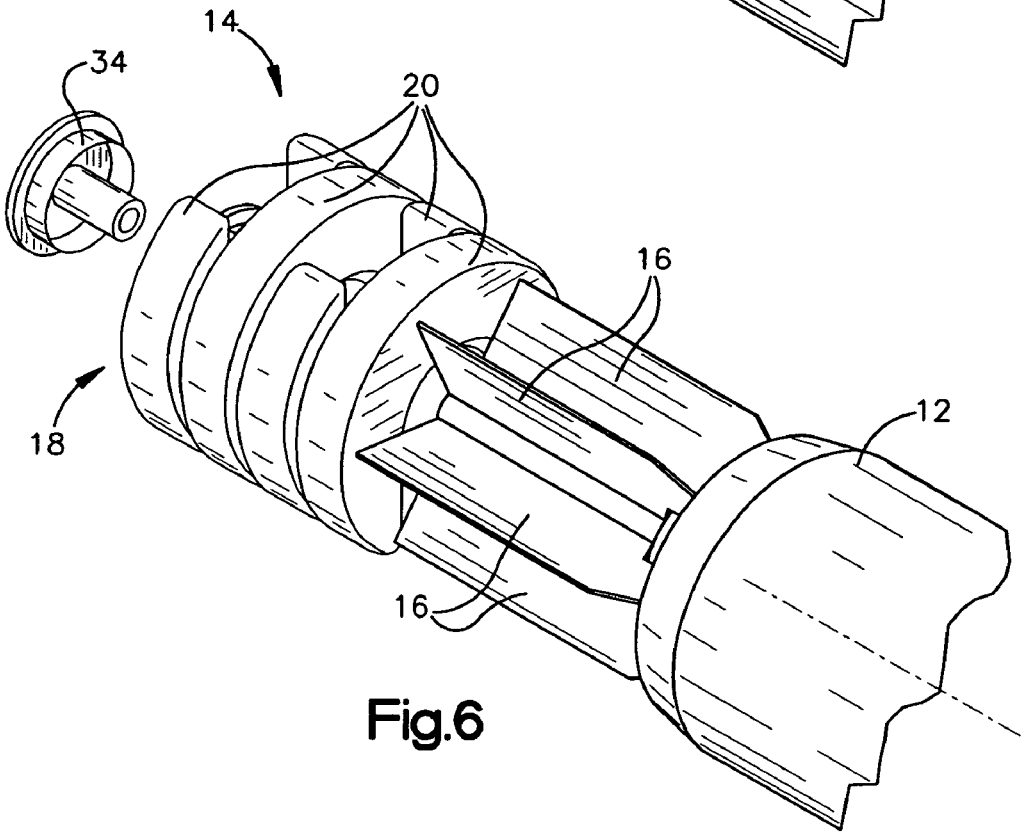
FIG. 6 is an oblique view illustrating a second step in the launch process of the projectile of FIG. 1.

FIGS. 5–8 illustrate various steps in the process of the launch of the projectile 10. FIG. 5 shows the initial configuration, just prior to ignition of the projectile 10. After ignition, as illustrated in FIG. 6, combustion of the internal propelling charge increment 28 (FIG. 3) causes the igniter holder 34 to be expelled from the propelling charge holder 22.

Figure 7:
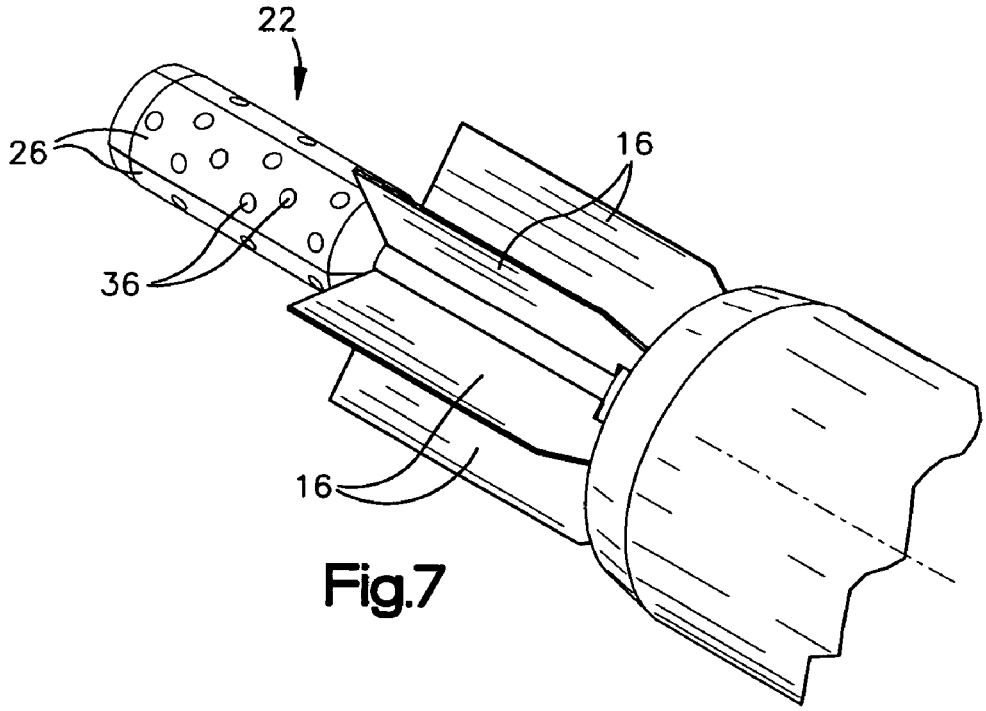
FIG. 7 is an oblique view illustrating a third step in the launch process of the projectile of FIG. 1.

As the projectile 10 continues movement within a cannon, the external propelling charges 20 are consumed, as is illustrated in FIG. 7. At this point, the segments 26 of the propelling charge holder 22 continue to be retained coupled to the projectile body 12 by the fins 16, which have not yet been deployed.

Figure 8:
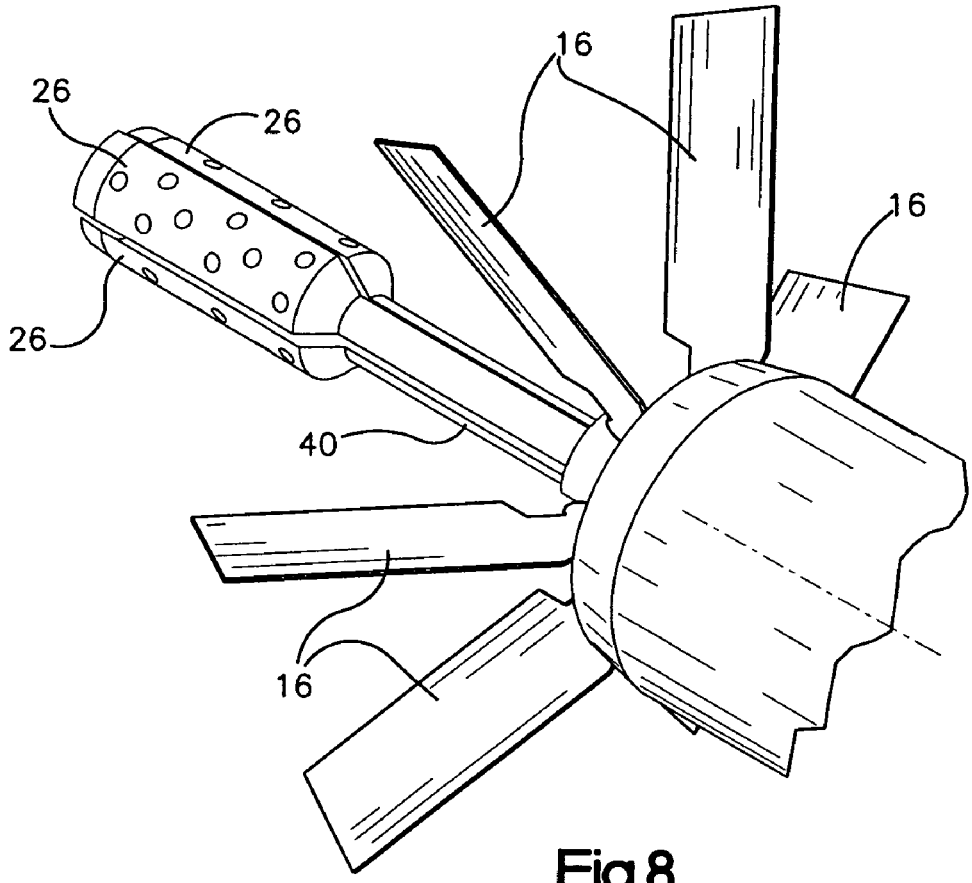
FIG. 8 is an oblique view illustrating a fourth step in the launch process of the projectile of FIG. 1.

Finally, in FIG. 8, the projectile 10 exits the cannon, and the fins 16 become deployed. Deployment of the fins 16 may be accomplished through a variety of well-known active or passive mechanisms. For example, high-pressure gases from the cannon may be sufficient to force the fins 16 outward as the projectile 10 exits the cannon. With the segments 26 of the propelling charge holder 22 no longer constrained, the segments 26 spring back to their free, bent shape, causing the hooked ends 40 of the segments 26 to disengage from the flange 42 of the aft projection 44 (FIG. 4) of the projectile body 12. The segments 26 then fall away from the projectile body 12 and the projectile 10 continues on its flight.

The propelling charge holder 22 thus provides a safely separable propelling charge holder, which does not have to be carried with the projectile 10 after launch, and which does not present an undue hazard to friendly personnel.

Figures 9, 10:
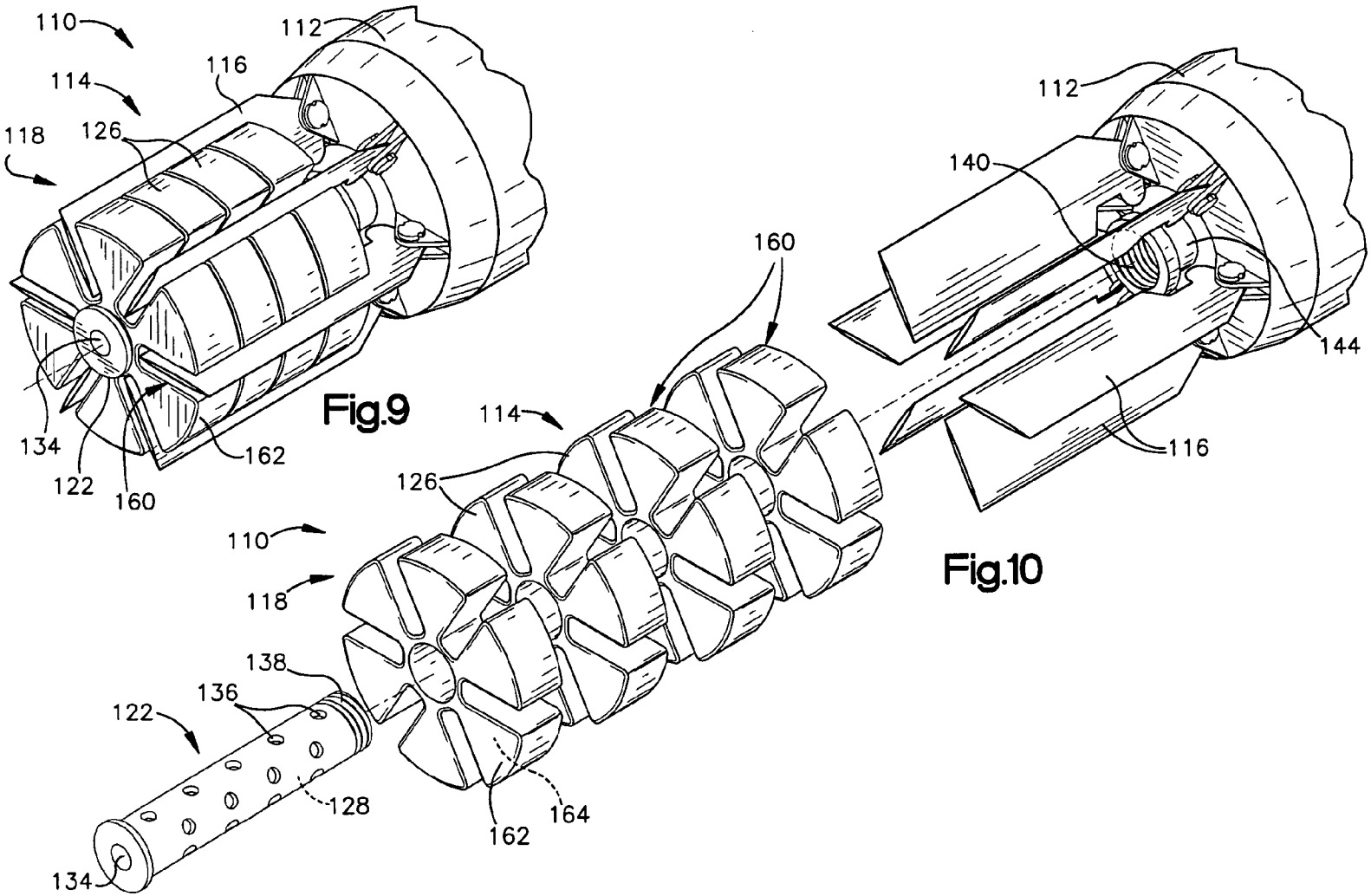
FIG. 9 is an oblique view of an alternate embodiment of a rear part of a projectile in accordance with an aspect of the invention.
FIG. 10 is an exploded view of the projectile of FIG. 9.

Turning now to FIGS. 9 and 10, an alternate embodiment is shown. The projectile 110 includes a tail 114 coupled to a projectile body 112. The tail 114 includes a propulsion system 118, which in turn includes plural propelling charge segments 126 coupled to a holder 122. The holder 122 surrounds an internal propelling charge increment 128, and has holes 136 therein for communicating with the propelling charge increments 126. The holder 122 also holds an igniter 134 that used for initiating combustion in the propulsion system 128.

Figure 11:
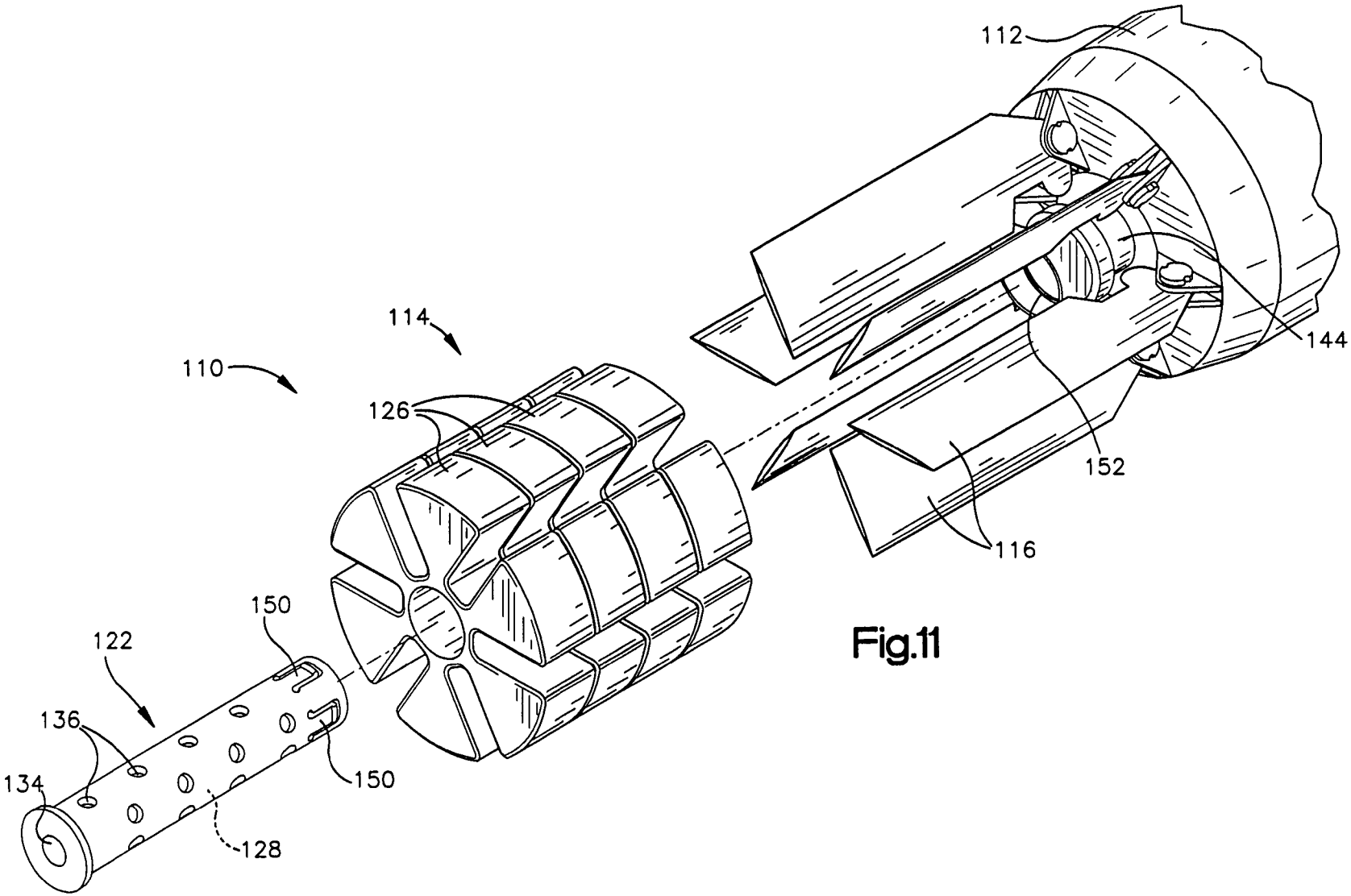
FIG. 11 is an oblique view of an alternate coupling between the charge holder and projectile body of the projectile of FIG. 9.

The holder 122 is separably mechanically coupled to the projectile body 112. As shown in FIG. 10, the holder 122 may have a threaded end 138 that engages with an internally-threaded hole 140 in an aft projection 144. Alternatively, as shown in FIG. 11, the holder 122 may be coupled to the aft projection 144 through a series of resiliently movable fingers 150 that enter into and engage a suitable groove 152 along in the aft projection 144. The holder 122 may be separated from the projection 144 in order to remove one or more of the propelling charge segments 126, thus allowing control of the amount of propellant used in the projectile 110.

The tail 114 includes folding fins 116 that nest in recesses 160 in the propelling charge increments 126. The propelling charge increments 126 and the holder 122 may be made of a consumable material that is substantially consumed during combustion of the propellant. For example, the propelling charge increments 126 may each include a shell 162 that surrounds and encloses a propellant material 164. The shell may be made of a pair of shaped halves bonded together, and filled with a suitable propellant material. An example of a suitable shell material for the propelling charge increments is felted nitrocellulose, or another combustible material with suitable mechanical properties. The holder may likewise be made of a suitable consumable material, for example felted nitrocellulose.

As noted above, a user may use different numbers of propelling charge increments 126, in conjunction with the holder 122, to produce different amounts of propulsive force on the projectile 110. Once the propulsion system 118 is installed on the aft projection 144 of the projectile body 112, ignition of the propelling charges is initiated through the igniter 134. Ignition of the igniter 134 causing combustion of the propellant in the internal propelling charge increment 128, which causes ignition of the propellant in the propelling charge increments 126, via the holes 136. Combustion of the propellant in the propelling charge increments 126 and 128 produces gases that are expelled in order to drive the projectile 110. After combustion of at least a majority of the propellant, the combustion also consumes most or substantially all of the holder 122 and the shells 162 of the propelling charge increments 126. The projectile 110 thus proceeds on its flight without the parasitic drag of a propelling charge holder. In addition, because the holder 122 is mostly or substantially fully consumed, there are no significantly-sized parts of the holder 122 that separate from the projectile body 112, to pose a possible hazard.

It will be appreciated that many of the individual features of projectiles 10 and 110 may be combined, where appropriate. For example, the multi-segment propelling charge holder feature of the projectile 10 may be combined with the feature of the projectile 110 of propelling charge increments with recesses for receiving fins.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a projectile body;

a propelling charge holder separably rigidly mechanically connected to the projectile body; and external propelling charge increments at least partially surrounding the propelling charge holder;

wherein the propelling charge holder includes multiple propelling charge holder segments that are separable from the projectile body and from one another during flight of the projectile, after the projectile has exited from a launcher.

2. The projectile of claim 1, further comprising an internal propelling charge increment in a chamber enclosed by the propelling charge holder;

wherein the chamber is defined by and within the multiple propelling charge holder segments.

3. The projectile of claim 2, wherein the segments have holes therein that allow communication between the chamber and the external propelling charge increments.

4. The projectile of claim 2, further comprising an igniter holder and an igniter that are both at least partially in the chamber.

5. The projectile of claim 1, further comprising fins hingedly coupled to the body forward of the propelling charge holder;

wherein the fins may be retracted or deployed.

6. A projectile comprising:

a projectile body;

a propelling charge holder separably mechanically connected to the projectile body; and external propelling charge increments at least partially surrounding the propelling charge holder, wherein the propelling charge holder includes multiple propelling charge holder segments; and fins hingedly coupled to the body forward of the propelling charge holder;

wherein the fins are retractable and deployable; and wherein the fins, when retracted, press against the propelling charge holder segments of the propelling charge holder.

7. The projectile of claim 6, wherein the fins press against a central portion of the propelling charge holder segments; and wherein the central portion of the propelling charge holder segments is closer to a centerline of the projectile than ends of the propelling charge holder segments.

8. The projectile of claim 7, wherein one of the ends of each of the propelling charge holder segments is a hooked end that engages an aft protrusion of the projectile body.

9. The projectile of claim 8, wherein the aft protrusion includes a flange that is engaged by the hooked ends.

10. The projectile of claim 8, wherein the fins each have a notch into which the hooked ends at least partially protrude when the fins are retracted.

11. A projectile comprising:

a projectile body;

a propelling charge holder separably coupled to the projectile body; and external propelling charge increments at least partially surrounding the propelling charge holder;

wherein the propelling charge holder includes multiple propelling charge holder segments;

wherein each of the propelling charge holder segments has a curved free shape with a central portion closer to a centerline of the projectile, and with ends located at opposite ends of the central portion, with the ends bowed radially outward away from the center line of the projectile; and wherein an inward radial force provided by the propelling charge increments is applied to the propelling charge holder segments to combine the propelling charge holder segments to form the propelling charge holder.

12. The projectile of claim 11, further comprising fins hingedly coupled to the body;

wherein the fins may be retracted or deployed; and wherein at least part of the inward radial force is supplied by the fins when the fins are retracted.

13. The projectile of claim 11, further comprising an igniter holder with an annular flange;

wherein at least part of the inward radial force is supplied by the annular flange.

14. The projectile of claim 11, wherein hooked ends of the propelling charge holder segments engage a flange on an aft protrusion of the body, when the inward radial force is applied to the propelling charge holder segments; and wherein removal of the inward radial force causes disengagement of the hooked ends from the flange.

15. A projectile comprising:

a projectile body;

a propelling charge holder separably coupled to the projectile body;

external propelling charge increments at least partially surrounding the propelling charge holder; and fins hingedly coupled to the body;

wherein the propelling charge holder includes multiple propelling charge holder segments that are separable from one another during flight of the projectile wherein the fins are retractable and deployable; and wherein blades of the fins each have a notch into which parts of the propelling charge holder segments protrude therein when the fins are retracted.

16. The projectile of claim 15, wherein the separable segments are at least partially surrounded by the propelling charge increments.

17. The projectile of claim 15 wherein the external propelling charge increments have recesses for receiving therein the fins.

18. A projectile of claim 15, wherein each of the external propelling charge increments includes a shell with a propellant within the shell; and wherein the shell is made of a material that is consumed by combustion of the propellant.

19. The projectile of claim 18, wherein the material includes felted nitrocellulose.

20. The projectile of claim 18, wherein the propelling charge holder is also made of a material that is consumed by combustion of the propellant.

21. The projectile of claim 15, wherein the propelling charge holder is made of a material that is substantially consumed during combustion of the propelling charge increments.

22. The projectile of claim 21, wherein the propelling charge holder is threadedly engaged with the projectile body.

23. The projectile of claim 21, wherein the propelling charge holder includes resilient fingers that engage the projectile body.

* * * * *